US005345725A

United States Patent [19]

Anthony

[11] Patent Number: 5,345,725

[45] Date of Patent: Sep. 13, 1994

[54] VARIABLE PITCH LAPPING BLOCK FOR POLISHING LENSES

[76] Inventor: Frank H. Anthony, 326 Atherton Dr., Metaire, La. 70005

[21] Appl. No.: 43,650

[22] Filed: Apr. 6, 1993

[51] Int. Cl.[5] ..... B24B 13/005

[52] U.S. Cl. ..... 451/390; 451/384

[58] Field of Search ..... 51/216 LP, 216 T, 217 L, 51/235, 124 L, 394, 284 R, 119, 120, 123 R; 15/230, 230.18, 97.1

[56] References Cited

U.S. PATENT DOCUMENTS 490,419 1/1893 Webster ..... 15/230.18
2,189,472 2/1940 Peterson ..... 15/230
2,475,972 7/1949 Longley ..... 15/230
3,886,696 6/1975 Bruck ..... 51/216 LP

FOREIGN PATENT DOCUMENTS 280082 11/1930 Italy ..... 15/230.18

*Primary Examiner*—Jack W. Lavinder
*Attorney, Agent, or Firm*—Nixon & Vanderhye

[57] ABSTRACT

A variable pitch lapping block for use in polishing a range of prescription lenses having different radii of curvatures is obtained by the use of an element made of rubber or the like, which is associated with a pressurized chamber, wherein the element exhibits a range of curvatures depending upon the variation of the pressure in the chamber.

15 Claims, 2 Drawing Sheets

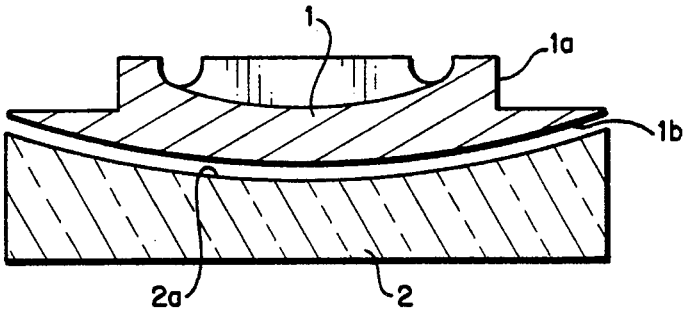
FIG. 1 (PRIOR ART)
FIG. 2a
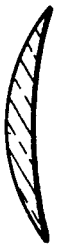
FIG. 2b
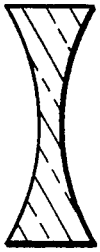
FIG. 2c
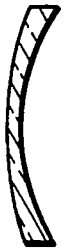
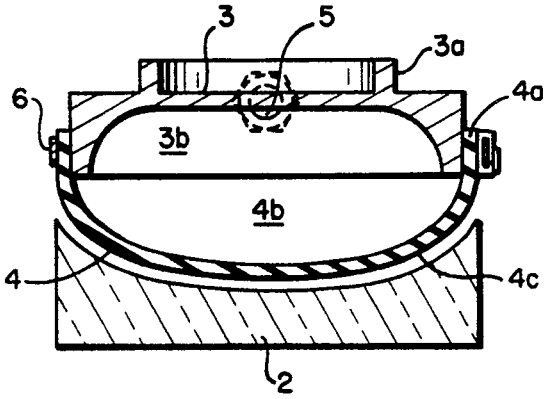
FIG. 3
FIG. 4
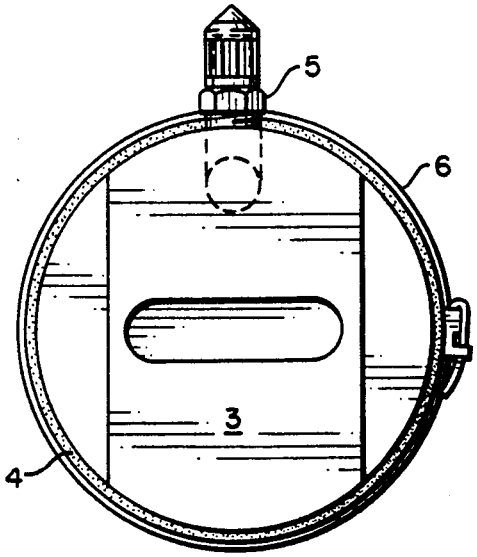

VARIABLE PITCH LAPPING BLOCK FOR POLISHING LENSES

FIELD OF THE INVENTION

The invention relates to improved lapping blocks for use in polishing glass or plastic prescription lenses.

BACKGROUND OF THE INVENTION

In the optical lens making industry precision lenses, such as those used for prescription eyeglasses, are conventionally produced by grinding the lens to a rough finish using diamond grinders and thereafter polishing the lens to prescribed dimensions and a fine finish. In the polishing of such lenses conventionally a steel or hard plastic lapping block, which is sized and configured for the particular desired prescription, is placed in movable mating contact with the surface of the rough cut lens.

A grinding compound, which is mixed with water to form a slurry, is introduced between the surfaces of the lapping block and the lens, while one or both the block and the lens are moved in a figure eight motion. Additionally, it is conventional to polish a lens in a coarse manner using a relatively coarse grinding compound and thereafter producing a fine polished surface through the use of a grinding compound containing relatively fine particulate manner. During the polishing operation a pressure of approximately 30 pounds per square inch is applied to the lapping block. The above noted procedure is continued until the desired results of a highly polished, uniformly finished lens surface are obtained.

A disadvantage of the conventional lens polishing procedure is that there are approximately 2,000 different prescriptions, each requiring a different lapping block with each having a different radius of curvature. Thus, approximately 2,000 different lapping blocks would be required in order to obtain polishing of all the possible different prescriptions which may be required in the finished lens.

SUMMARY OF THE INVENTION

I have discovered that through the use of a variable pitch lapping block the number of different lapping blocks necessary for polishing prescription lenses may be substantially reduced. In this regard, the working surface of a conventional lapping block may be replaced with a flexible and expandable surface, such as that of a rubber bladder exhibiting a curved surface wherein the curvature of the surface may be adjusted by varying the air pressure on the inner or non-working surface of the bladder.

Thus, by varying the air pressure applied through a valve in the lapping block to the flexible working surface, a variable pitch lapping block exhibiting a range of radii of curvatures may be obtained wherein the variation in air pressure may be used to conform the flexible surface to the curvature of the unpolished rough cut lens surface. In this manner, a single lapping block having a variable pitch surface controlled by pneumatic or hydraulic pressure may be used to polish a wide range of different prescriptions for glass or plastic lenses.

The objects and advantages of my invention will be more completely understood and appreciated by the artisan carefully studying the following description of the presently preferred exemplary embodiment taken in conjunction with the accompanying drawings of which:

BRIEF DESCRIPTION OF THE DRAWINGS

FIG. 1 illustrates a cross sectional view of a conventional lapping block and lens as used in the prior art for polishing the lens;

FIGS. 2*a*, 2*b* and 2*c* are illustrative of the cross sections of conventional convergent and divergent lens shapes;

FIG. 3 is a cross sectional view illustrative of my presently preferred exemplary embodiment of a lapping block having variable pitch useful in polishing lenses having a range of radii of curvature;

FIG. 4 is a top view of the exemplary embodiment of the lapping block of FIG. 3.

DETAILED DESCRIPTION OF THE DRAWINGS

Figure 5:
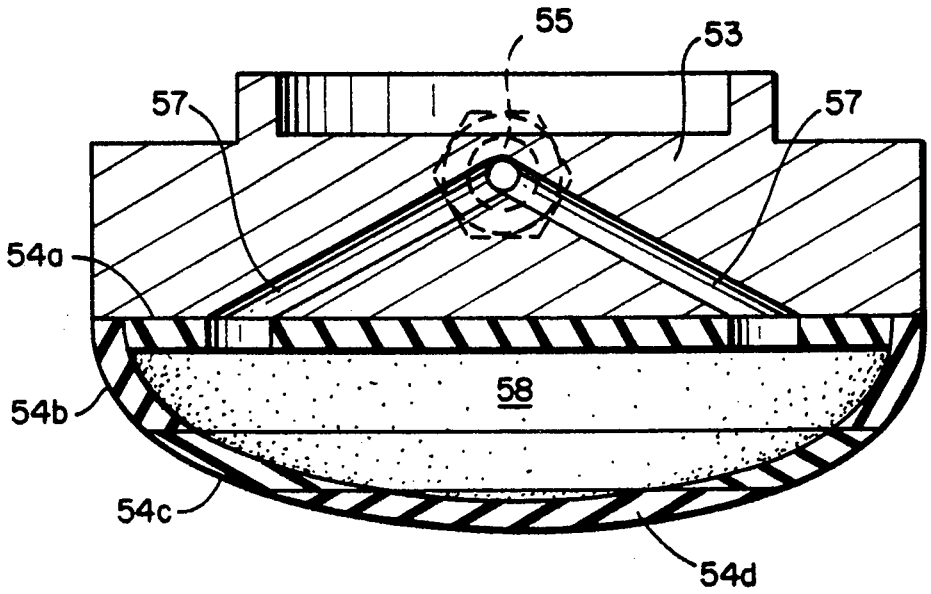
FIG. 5 is a cross sectional view of an alternative exemplary embodiment of my variable pitch lapping block.

FIG. 1 is illustrative of a standard metal or hard plastic lapping block 1 as used in the optical industry for polishing a glass or plastic lens 2 so that surface 2*a* results in a very smooth, highly polished surface having a uniform radius of curvature across the surface. The raised portion 1*a* of the lapping block is designed to be attached to an actuating mechanism of a polishing machine. Moreover, surface 1*b* of the lapping block is precisely formed with a radius of curvature for a particular lens prescription. Clearly, the radius of curvature can vary over a range from large to relatively small radii.

As may be seen from a consideration of FIGS. 2*a* to 2*c*, exemplary conventional lens types of both divergent and convergent form are known and are used, for example, in prescription eyeglasses. Such generalized lens types, however, include a wide variety of radii of curvature in order to comply with approximately 2,000 separate prescriptions.

A lens for a particular prescription, for example, is conventionally initially formed or cut to prescription by a diamond grinder or cutting device and thereafter polished through the use of a lapping block 1 configured for the particular prescription, thus requiring a large number of separate lapping blocks. Once the appropriate lapping block has been selected for the desired prescription, the lapping block and unpolished lens are respectively attached and clamped in polishing machines in a conventional manner. Thereafter, a slurry comprising water and a grinding compound is pumped between the lapping block and lens as they are both moved in a figure eight manner so as to polish the lens surface to a uniform prescribed radius of curvature. As previously noted, it is conventional to coarsely polish the lens surface and thereafter fine polish the surface by means of slurries containing coarse and then fine grinding compounds.

FIGS. 3 and 4 illustrate the presently preferred exemplary embodiment of my variable pitch lapping block shown in cross section and top view, respectively. The device includes a metal or hard plastic element 3 having an upper portion 3*a* designed to be attached to lens polishing machines in a conventional manner. Element 3, however, includes a hollow central portion 3*b*, which together with portion 4*b* to be described below forms an air or fluid chamber. Element 3 additionally includes a valve element 5 for the admission of air and/or other fluids so as to pressurize the interior chamber to a desirable pressure.

Resilient element 4 made of rubber or the like is attached at 4*a* to the metal or plastic element 3 by band clamps 6, adhesives, vulcanization processes or other conventional fastening means so as to provide the lower portion 4*b* of the fluid tight variable pressure interior chamber whereby the radius of curvature of the exterior surface 4*c* may be modified to be larger or smaller depending upon the pressure of the fluid introduced into the chamber formed by portions 3*b* and 4*b*.

In a conventional lapping block of the nature illustrated in FIG. 1, approximately 30 pounds per square inch of pressure is applied to the lapping block during the lens polishing procedure. In the use of my variable pitch lapping block shown in FIGS. 3 and 4, by varying the pressure on the block, as well as the pressure within the chamber formed by portions 3*b* and 4*b*, the exterior surface 4*c* of the elastically resilient element 4 will conform to a range of curvatures exhibited by the rough cut, unpolished lens 2 so as to produce uniform polished surfaces of the desired radius of curvature. An exemplary elastically resilient element 4 may be formed of rubber material (with or without fiber reinforcement) of approximately one-eighth inch in thickness. Additionally, as will be noted with respect to the embodiment of FIG. 5, the resilient element 4 may be made so that different portions of the element are made of rubber having different durometer hardnesses. Moreover, it is contemplated that the use of a relatively small number of such rubber bladder elements 4 having different radii of curvature in the unpressurized condition will be adequate to cover the entire span of approximately 2,000 different prescriptions, as opposed to the presently used approximately 2,000 different lapping blocks, each dedicated to a particular prescription.

In its simplest form, my variable pitch lapping block may comprise a hollowed out conventional lapping block with the bottom portion including surface 1*b* removed and with a valve 5 such as a conventional air valve included so as to communicate with chamber portion 3*b*. Additionally included is a rubber bladder element 4 which is configured to overlap the sides of the lapping block portion 3 where it is clamped by a metal band clamp 6 about the circumference of element 3 to form chamber portion 4*b*. Alternatively, element 4 may be glued or vulcanized in place so that it adheres to the sides of the block with or without the aid of the metal band clamp. As will be appreciated, outer surface 4*c* of the bladder element will exhibit a variable range of radii of curvature depending upon the pressure of the interior air chamber.

FIG. 5 illustrates in cross section an alternative embodiment wherein a conventional lapping block 53 with the bottom portion removed may be used but without being hollowed out as in FIG. 3. However, conventional air valve 55 and drilled airways 57 are included for communicating with and pressurizing the chamber 58 formed by rubber bladder element 54.

The rubber element 54 may include a flat top portion 54(*a*) of hard rubber attached to the lower surface of block 53 by adhesives or by vulcanizing to the block. Element 54 may also include two or more sections (54*b*, 54*c* and 54*d*, for example) made of rubber of different hardnesses. For example, portion 54*b* may be made of relatively soft rubber and portion 54*c* of rubber having medium hardness. In contrast portion 54*d* may be of medium-hard rubber for increased wear resistance. This alternative embodiment operates in a manner similar to that illustrated in FIG. 3 in that it will exhibit a variable range of radii of curvature depending on the pressure of the air chamber 58. Moreover, the rubber element 4 of FIG. 3 may also include one or more portions of rubber having different hardnesses as in FIG. 5.

While the invention has been described in connection with what is presently the most practical and preferred embodiments, variations will occur to those skilled in the art. For example, element 4 may be formed of other elastically resilient materials and/or be configured to include an upper portion for added leak resistance which would conform to the inner walls of chamber portion 3*b*, such portion being integrally molded with element 4, as presently illustrated. Additionally, although the chamber formed by portions 3*b* and 4*b* is presently contemplated to form a pressurized air chamber, it is clear that other fluids including liquids or combinations of liquids and gases may be used. Thus, it is to be understood that the invention is not to be limited to the disclosed embodiment but, on the contrary, is intended to cover various modifications and equivalent arrangements included within the spirit and scope of the appended claims.

What is claimed is:

1. A variable pitch lapping block for use in polishing optical lenses in an apparatus for polishing lenses having any one of a plurality of radii of curvatures, said lapping block comprising:

a rigid lapping block body element having a top portion structured for attachment to said apparatus and outer side walls extending downward and away from said top portion for forming an upper portion of a chamber, a resiliently elastic element having edges and a radius of curvature between the edges, said edges being attached at said side walls to form a closure for said chamber, and a valve element extending through a side wall of said rigid lapping block body element and communicating with said chamber for admitting pressurized fluid into said chamber for changing the radius of curvature of said resilient elastic element to conform to a selected one of said plurality of radii of curvatures of said lenses.

2. A variable pitch lapping block as in claim 1 wherein said resiliently elastic element is adhesively attached at said edges to the side walls of said lapping block body element.

3. A variable pitch lapping block as in claim 1 wherein said resiliently elastic element is attached to said side walls by clamp means.

4. A variable pitch lapping block as in claim 1 wherein said resiliently elastic element includes an upper portion extending along said upper portion of said chamber.

5. A variable pitch lapping block as in claim 1 wherein said lenses are prescription lenses to which the radius of curvature of said resiliently elastic element conforms.

6. A variable pitch lapping block as in claim 5 wherein the radius of curvature of said resiliently elastic element is expanded by fluid pressure in said chamber to a radius of curvature of one of said plurality of radii of curvatures of said lenses so as to uniformly polish a lens surface to a prescribed radius of curvature.

7. A variable pitch lapping block as in claim 6 wherein a slurry of grinding compound is placed between said resiliently elastic element and said lens surface for polishing said surface.

8. A variable pitch lapping block as in claim 1 wherein said fluid is air.

9. A variable pitch lapping block as in claim 1 wherein said rigid lapping block body element is made of metal or plastic.

10. A variable pitch lapping block as in claim 1 wherein said resiliently elastic element is made of rubber.

11. A variable pitch lapping block as in claim 1 wherein said outer side walls extend from said top portion to form a hollow open ended upper portion of said chamber.

12. A variable pitch lapping block as in claim 1 wherein said side walls extend to a lower planar surface of said body element.

13. A variable pitch lapping block as in claim 12 wherein said resiliently elastic element includes an upper planar surface attached to said edges and said upper and lower planar surfaces are attached to each other.

14. A variable pitch lapping block as in claim 1 wherein said resiliently elastic element includes two or more sections each made of material having different hardnesses.

15. A variable pitch lapping block as in claim 14 wherein said material is rubber.

* * * * *